United States Patent [19]

Rusch

[11] 4,222,019

[45] Sep. 9, 1980

[54] CIRCUIT BREAKER WITH MANUAL RELEASE

[75] Inventor: Arthur Rusch, Emmenbrüke, Switzerland

[73] Assignee: Weber AG, Fabrik Elektrotechnischer Artikel und Apparate, Emmenbrucke, Switzerland

[21] Appl. No.: 929,232

[22] Filed: Jul. 31, 1978

[30] Foreign Application Priority Data

Aug. 5, 1977 [CH] Switzerland ..... 9637/77

[51] Int. Cl.[2] ..... H01H 13/04; H01H 9/34

[52] U.S. Cl. ..... 335/6; 335/23; 335/202

[58] Field of Search ..... 335/6, 202, 35, 39, 335/23

[56] References Cited

U.S. PATENT DOCUMENTS

| | | | |
|---|---|---|---|
| 3,889,215 | 6/1975 | Yoshino et al. | 335/202 |
| 4,087,772 | 5/1978 | Grenier | 335/202 |

*Primary Examiner*—Harold Broome

*Attorney, Agent, or Firm*—Browdy and Neimark

[57] ABSTRACT

A circuit breaker including a manually operated lever, a movable contact lever for opening and closing the electrical circuit through the circuit breaker, a switch latch which connects the manually operated lever to the movable contact lever and which activates the movable contact lever, a thermal trigger connected to the switch latch and a magnetic trigger, connected to the switch latch. The magnetic trigger, the contact lever, the switch latch and the thermal trigger all occupy separate compartments.

13 Claims, 2 Drawing Figures

CIRCUIT BREAKER WITH MANUAL RELEASE

FIELD OF THE INVENTION

The invention relates to circuit breakers.

BACKGROUND OF THE INVENTION

In known circuit breakers of this type, for example German Pat. Nos. 1,141,365 and 1,590,759, as well as German Offenlegungsschrift No. 26 51 158, the magnetic trigger is arranged laterally to produce a small circuit breaker.

As a result of this cramped design, in known circuit breakers the switch latch, contact elements, and their electrical leads as well as the magnetic trigger are partially interlocked, which not only makes it more difficult to assemble the circuit breaker and to provide an additional thermal trigger, e.g. a bimetallic element, but also makes it difficult to provide adequate electrical separation of the various components.

SUMMARY OF THE INVENTION

The goal of the present invention is to provide a circuit breaker that is easy to assemble, with a low height, wherein spatial and electrical separation of its components are provided to achieve reliable operation at high cutoff power levels.

According to the invention, the circuit breaker of the type described hereinabove comprises a switch latch extending essentially in a straight line between a lever which manually operates the circuit breaker and a movable contact lever, which can interupt the flow of electricity through the circuit breaker, the latter being disposed in the vicinity of the bottom of the housing and being swivelable parallel thereto, with its contact point being in an arc in an arc chamber located laterally with respect to the switch latch, and separated thereform by insulating walls. An additional housing chamber is provided separate and above the arc chamber wherein a magnetic trigger is disposed, the magnetic trigger is provided with a hinged armature which can actuate a trigger lever on the switch latch, and extends toward the latter.

The division of the circuit breaker into chambers which are occupied by the switch latch, the movable contact lever, and the magnetic trigger, permits reliable and rapid assembly of the circuit breaker and provides advantageous electrical separation, which prevents the arc created when the contact lever moves out of contact with a part of the circuit running through the circuit breaker, from contacting the switch latch parts. The thermal trigger is disposed on the side of the switch latch which is opposite the magnetic trigger and the arc chamber. The trigger lever is a two-armed lever, and extends over most of the height of the circuit breaker.

An embodiment of the circuit breaker according to the invention is described hereinbelow with reference to the drawing.

DETAILED DESCRIPTION OF THE PREFERRED EMBODIMENT

Figure 1:
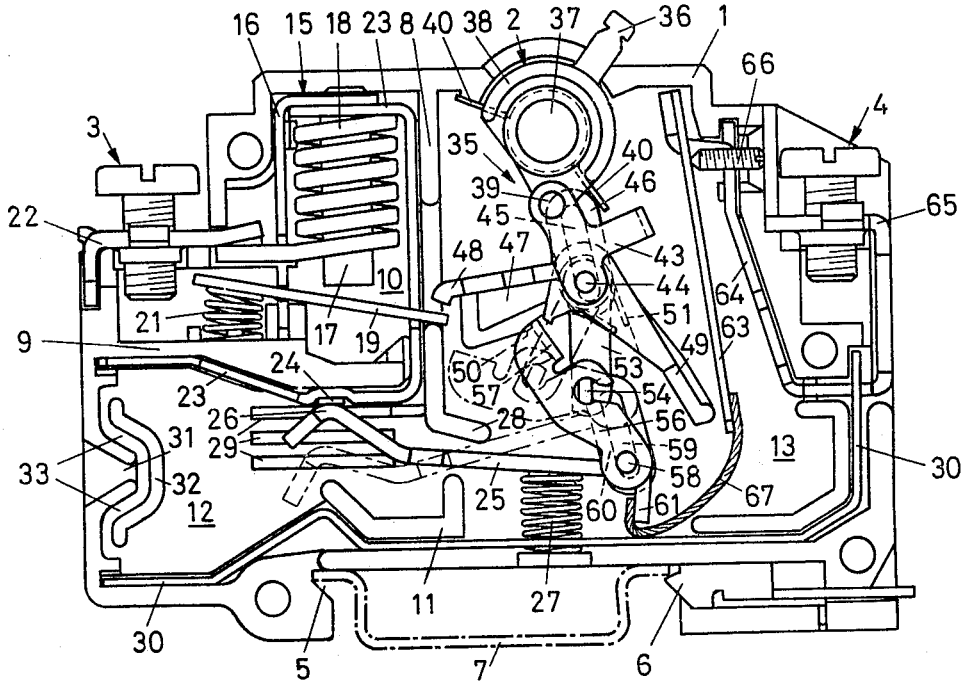
FIG. 1 is a view of the circuit breaker in the on position, with the independent triggering state indicated.
Figure 2:
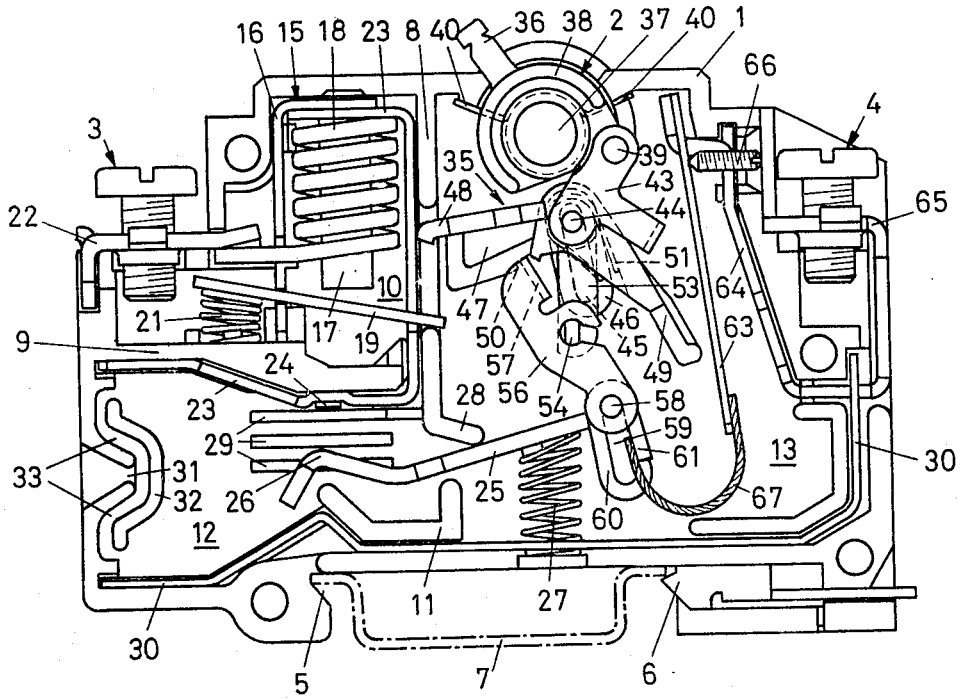
FIG. 2 is a view of the same circuit breaker, in the off position.

The circuit breaker shown in FIGS. 1 and 2 comprises an essentially rectangular shell-type insulating housing 1, which is closable by means of a flat insulating cover which is not shown and can be placed upon housing 1. A lever 2 projects from the upper side of housing 1 to allow manual operation of the circuit breaker. Two terminals 3 and 4, designed as screw terminals, are disposed on the lateral sides of the housing, with terminal 3 being the input terminal and terminal 4 being the output terminal. Means 5 and 6 are provided on the underside of housing 1 to mount the circuit breaker on a track 7, represented by a dot-dash line, said track being located for example in a fuse box or distributor box. The fastening means mentioned hereinabove consist in known fashion of a housing groove 5 and a housing slide 6, likewise provided with a groove, said elements serving to clamp the circuit breaker firmly in the manner shown on track 7.

Housing 1 as shown also comprises internally a plurality of walls, projections, or ribs, of which the most important are shown in FIGS. 1 and 2. In particular, walls 8 and 9 as well as adjacent side walls of housing 1 delimit a magnetic trigger chamber 10, and a section of wall 8, wall 9, and bent rib 11, and adjacent side walls of housing 1 delimit a contact and arc chamber 12, while the rest of housing chamber 13 serves essentially as a switch latch chamber, as well as a space to accommodate a thermal trigger. In the following, the individual parts of the present circuit breaker disposed in the above-mentioned housing chambers 10, 12 and 13 as well as their functions will be described in greater detail, proceeding from input terminal 3 to output terminal 4.

Magnetic trigger chamber 10 contains a magnetic trigger 15, provided with a magnetic core 17 fastened to a magnetic yoke strip 16, said core 17 being surrounded by a cantilevered winding 18 as well as a hinged armature 19, swivelably mounted on magnet yoke strip 16, passing through a opening in wall 8 with its inner end and held in the resting position shown by a spring 21. One end of winding 18 is soldered to a terminal plate 22 of terminal 3. The other end of winding 18 is connected to one end of a strip conductor 23 firmly attached to yoke strip 16 and core 17, said conductor 23 being guided along the side of wall 8 which faces away from wall 9 and magnetic trigger chamber 10. In contact and arc chamber 12, conductor 23 is a contact support and is provided with a contact plate 24 which makes a firm contact with movable contact element 26.

In contact and arc chamber 12, which is located beneath magnetic trigger chamber 10, there is a portion of a contact lever 25 bent in the form of a horn, which extends essentially horizontally through a slot between the bent ends of wall 8 and rib 9 into switch latch chamber 13 and is pivotably mounted therein in a manner to be described hereinbelow. Contact lever 25 forms a movable contact element 26 and is subjected to pressure from a contact spring 27 which abuts the bottom wall of the housing 1. The free bent end 28 of wall 8 serves as a stop for a contact lever 25 and as a rotational axis when the contact lever is brought into the off position as shown in FIG. 2.

In the vicinity of fixed contact plate 24 and the horn-shaped bent end of contact lever 25, the large lateral surfaces of housing 1, are provided with ribs 29, which increase the insulated path between conductor 23 and an additional conductor 30 guided along the bottom wall of housing 1, the conductor 30 being connected with terminal 4 on the output side. The distance between conductors 23 and 30 increases toward the left and outward in FIGS. 1 and 2, from the point where the distance between them is minimal at 24 and 26, an arc is created by the opening of contact 24 and 26. At the end of the expanding arc chamber 12, the side wall of housing 1 is provided with an opening 31 to allow the gases created by the arc to escape to the outside. A bent rib 32 is disposed in front of opening 31 to cool the hot gases, said rib forming channels 33 which guides the gases from arc chamber 12 to the opening.

A switch latch chamber 13, located next to the magnetic trigger chamber 10 and the contact and arc chamber 12 and extending over the entire height of the circuit breaker, contains lever 2, the mounted part of contact lever 25 together with contact spring 27, and a switch latch 35 which links the latter to the former and is designed as a toggle joint system.

Lever 2 is provided with a handle 36 and a disc-shaped bearing part 37, with arcuate ribs 38 projecting on both sides, said ribs engaging matching grooves in the large lateral surfaces of housing 1 and the cover, not shown. Bearing part 37 is also provided on both sides with short pins 39. A torsion spring 40 exerts a counterclockwise torque on lever 2.

A bracket-shaped lateral part of a bow 43 is pushed onto pins 39 of lever 2. The lateral parts of bow 43 are each provided with an additional hole, through which a first bearing pin 44 is inserted.

The ends of bearing pin 44 are each guided in the large lateral surfaces of the housing and cover in a groove 45 which is inclined slightly with respect to vertical, said groove being delimited by beaded edges 46 formed in the large lateral surfaces of the housing.

A two-armed trigger lever 47 is also swivelably mounted on pin 44, on arm 48 of said lever being directed nearly horizontally and the other arm 49 being directed diagonally downward. Arm 48 is provided on its underside with a sharpedged step 50. A leg spring 51 exerts a counterclockwise torque on the trigger lever 47.

Finally, a lever 53, shown hereinafter with a pawl support, is swivelably mounted on pin 44 to serve as a support for a pawl described hereinbelow, said lever 53 being provided at its lower end on both sides with pins 54. Lateral parts of a bow-shaped pawl 56 are swivelably mounted in slots on both sides of pin 54. The lateral parts are connected at their upper ends by a yoke 57, whose upper edge is designed to lock behind step 50 of the trigger lever 49. At their lower ends, the lateral parts of pawl 56 are provided with a bore whereby a second bearing pin 58 is inserted through these bores. The ends of bearing pin 58, like those of bearing pin 44, are each guided in the large lateral surfaces of the housing and the cover in a groove 59, likewise delimited by a beaded edge 60.

In addition, rounded end 61 of contact lever 25 is swivelably mounted on second bearing pin 58.

It is obvious that lever 2, bow 43, pawl support 53 and pawl 56 constitute a double toggle joint system with two translationally guided articulation points, namely bearing pins 44 and 58, and two deflecting articulation points, namely pin 39 of lever 2 and pin 54 of pawl support 53, whereby the upper, deflecting articulation point, namely pins 39 of lever 2, runs over the dead point of this toggle joint as shown in FIGS. 1 and 2.

The circuit breaker shown is also provided with a thermal trigger comprising a bimetallic element 63. Bimetallic element 63 is fastened to one end of a multiply bent strip-shaped conductor 64, held in housing 1 by a plurality of housing parts, (not shown) and with its other end constituting a connecting plate 65 for output terminal 4. An adjusting screw 66, screwed into conductor 64, serves to adjust bimetallic element 63. A braided segment 67 connects the free, movable end of bimetallic element 63 with the bent end 61 of contact lever 25. Bimetallic element 63 extends over most of the height of the housing and is disposed in the vicinity of arm 49 of trigger lever 47.

Conductor 30, which serves as a conducting strip for the arc, is connected mechanically with conductor 64, connected to the output terminal, and is also held between the parts of the housing.

With the circuit breaker in the on position as shown in FIG. 1, toggle joint system 43, 47, 53, 56, including lever 2 and contact lever 25 constitutes a rigid system as long as no external forces act upon it. Contact spring 27 forces contact lever 25 upward, so that the movable contact 26 is pressed against fixed contact plate 24. End 61 of contact lever 25, mounted on second bearing pin 58, is likewise forced upward. Bearing pin 58, however, cannot move upward in groove 59, since it is retained by pawl 56. Pawl 56 in turn cannot rotate counterclockwise about pin 54 of pawl support 53, since it is held firmly by step 50 of release lever 47. Likewise, the pawl 56 itself cannot shift upward; the upwardly directed force component forces lever 2, through pawl support 53 and bow 43, against the "on" housing stop of handle 36 of lever 2. Of course, it is assumed that the torque produced by torsion spring 40 is less than the torque exerted by bow 43 as a result of contact spring 27 pushing against lever 2.

If a severe excess current appears, for example as the result of a short circuit, winding 18, traversed by the current, magnetizes magnet core 17 so that the latter attracts hinged armature 19, and hinged armature 19 in turn swivels release lever 47 clockwise. The result is the same if bimetallic element 63 is deflected leftward after being heated by the passage of a current, thus exerting a pressure upon arm 49 of release lever 47. The swiveling of release lever 47 releases pawl 56. Under the pressure of contact spring 27, second bearing pin 58 is displaced upward in groove 59, so that contact lever 25 strikes against end 28 of wall 8 and swivels about this stop, so that the movable contact part 26 is separated from the fixed contact plate 24. At the same time, pins 54 of pawl support 53 are forced leftward by pawl 56, so that pawl 56 and pawl support 53 assume the intermediate position shown by the dot-dash lines in FIG. 1, while contact lever 25 finally comes to rest in the off position, likewise shown by dot-dash lines. Since a torque is exerted upon lever 2 which is opposed to the torque produced by torsion spring 40 during the movement of second bearing pin 58 in groove 59, via pawl 56, pawl support 53, and bow 43 as before, first bearing pin 44 and bow 43 do not change their positions at first.

However, when the second bearing pin 58 strikes the upper end of groove 59, the torque which is opposite in direction to the torque produced by torsion spring 40, disappears. This causes bearing part 37 of lever 2 to swivel counterclockwise, while bow 43 swivels through its dead point and is rotated upward in groove 45 under the influence of the movement of the first bearing pin 44, whereby release lever 47 is likewise pulled upward, and pawl support 53 and pawl 56 assume an extended position. Leg spring 51 swivels release lever 47 against pawl 56, so that its step 50 is again on yoke 57 of pawl 56. This "off" position is shown in FIG. 2.

It is clearly evident that excess current will also trigger the circuit breaker when lever 2 is held in its "on" position for any reason whatever, since the position of contact lever 25 represented by the dot-dash lines in FIG. 1, like the positions of pawl 56 and pawl support 53, does not result in any change in the position of lever 2. As long as lever 2 is held, this position, with contacts 24 and 26 completely open, is maintained, thus allowing independent triggering.

It is also clear that in the case of manual operation, achieved by throwing lever 2, the movement steps described above occur in a different sequence. Pawl 56 is released to open contacts 24 and 26 by flipping lever 2 and thus pulling release lever 47 upward as bow 43 pivots through its dead point.

When putting the circuit breaker in the on position, i.e. when changing the circuit breaker from the state shown in FIG. 2 to the state shown in FIG. 1, both bearing pins 44 and 58 are slid downward in their grooves 45 and 59 by the swiveling of bow 43. Pins 54 of pawl support 53 cannot be deflected under these circumstances, since pawl 56 abuts step 50 of release lever 47. This causes contact spring 27 to be tensioned by flipping lever 2, and to be held in this position as long as bow 43 is beyond its dead point; see FIG. 1.

In the present circuit breaker, the components can be assembled very simply. The magnetic trigger 15, including the terminal 3 on the input side and conductor 23 which supports contact plate 24, can be inserted as preassembled unit in housing 1, whereby only spring 21 is provided separately for hinged armature 19. The same is true of terminal 4 on the output side, including conductor 64 which supports bimetallic element 63, and additional conductor 30. Bearing pins 44 and 58 as well as pins 39 and 54 permit all parts of the switch latch 13 including lever 2 to be assembled and inserted in housing 1, whereby contact lever 27, connected to bimetallic element 63 by braided section 67, is installed last. Its contact spring 27 can be added simultaneously or afterward. The cover, not shown, is then installed on housing 1 and connected to the latter. Jamming or jumping out of individual components is prevented by guiding bearing pins 44 and 58 in grooves 45 and 59 in such manner that the internal housing walls and housing ribs have the same heights as the external housing lateral walls. Automatic tensioning of torsion spring 40 of lever 2 can be accomplished by providing housing 1 in the vicinity of the "on" stop of handle 36 of lever 2 on the housing with a sloping surface, so that as lever 2 is inserted in housing 1, rib 38 of bearing part 37 of lever 2 pushes one bent end of torsion spring 40 ahead of itself across this sloping surface, after which this end of the spring comes to rest against rib 38 when lever 2 has been installed, as shown in FIGS. 1 and 2.

The present circuit breaker also advantageously comprises a very small number of components. In particular, no more than seven movable parts are required for locking and releasing, aside from two bearing pins 44 and 58 and three springs 27, 40, and 51: namely lever 2, contact lever 25, switch latch parts bow 43, release lever 47, pawl support 53 and pawl 56, as well as hinged armature 19 and bimetallic element 63.

The present circuit breaker also has advantageous switching characteristics. Its arc chamber 12 is relatively large and constituted by divergent conductor elements 23 and 30 in such manner that the arc is driven toward outlet 31. Since contact lever 25 is guided in a slot between housing wall 8 and housing rib 11 into switch latch chamber 13, the arc cannot enter switch latch chamber 13. The arrangement of movable contact lever 25 and contact spring 27 which is shown also results in a large opening-force moment and a large contact-separating force. As a result of the slightly inclined position of groove 59 with respect to a vertical axis, movable contact element 26 slides along fixed contact plate 24 when the switch is put in the on position. For these reasons, high switching efficiency is achieved, and extinguishing plates generally need not be provided in arc chamber 12. Finally, switch latch 35 does not carry any voltage, if pawl 56 and release lever 47 are advantageously made of plastic.

It will be obvious to those skilled in the art that various changes may be made without departing from the scope of the invention and the invention is not to be considered limited to what is shown in the drawing and described in the specification.

What is claimed is:

1. A circuit breaker with a manual release comprising:

a manual lever;

a movable contact lever means for opening and closing the electrical circuit through the circuit breaker by moving between an opened and a closed position;

a magnetic triggering means, for sensing severe excess current running through the circuit breaker;

a toggle joint means, for moving said contact lever means from the closed position to the open position and from the open position to the closed position in response to movement of said manual lever and in response to said magnetic triggering means; said toggle joint means being disposed in a substantially straight line between said manual lever and said movable contact lever means, said movable contact lever means being swivably attached to said toggle joint means;

a hinged armature, connected to said magnetic triggering means;

a triggering lever, attached to said toggle joint means, for triggering said toggle joint means to cause said movable contact lever to open or close the circuit in the circuit breaker in response to said hinged armature contacting said triggering lever; and a housing in which the circuit breaker is disposed, having separate compartments for said magnetic triggering means, said movable contact lever means, and said toggle joint means, said magnetic triggering means and said movable contact lever means being disposed laterally from said toggle joint means, said compartment for said movable contact lever means being below said compartment for said magnetic triggering means and forming part of the bottom of said housing, said movable contact lever means being disposed in said compartment substantially parallel to the bottom of said housing; and wherein said housing has grooves along the length thereof and wherein said toggle joint means further comprises a bow, articulated to said manual lever, a support lever, a pawl articulated to said support lever, a first pin, a second pin, a release lever, said bow, support lever and release lever all being swivelably mounted on said first pin, said pawl being capable of being locked in position by said release lever and being also swivelably mounted on said second pin, said second pin also supporting one end of said movable contact lever means, wherein both pins are displaceably guided in the grooves of said housing in the lengthwise direction.

2. A circuit breaker according to claim 1, further including a first spring abutting the bottom of said housing and the bottom of said movable contact lever means, wherein said spring applies an upward force to said movable contact lever means.

3. A circuit breaker, according to claim 2, further including a handle, connected to said manual lever;

a second spring, attached to said manual lever, for producing a torque for urging said manual lever to rotate in a direction opposite from the direction which said bow urges said manual lever to rotate when said movable contact lever means is in the closed position, and when said bow is inclined relative to said support lever, wherein said torque produced by said second spring on said manual lever is less than the torque produced by said bow on said manual lever.

4. A circuit breaker according to claim 1 or 2, further including a plurality of pins connected to said manual lever and a plurality of pins connected to said support lever, wherein said bow is also swivelably mounted on said pins of said manual lever, and said pawl is also swivelably mounted on said pins of said support lever.

5. A circuit breaker, according to claim 1, further including a bimetallic element disposed on the side of said toggle joint means which is opposite said magnetic triggering means;

said release lever further comprising:

a first and a second projecting arm, disposed on opposite sides of said first pin, said first projecting arm being actuatable by said hinged armature, said second projecting arm being actuatable by said bimetallic element.

6. A circuit breaker according to claim 1, further including a braided conducting segment connected to said output terminal, wherein one end of said movable contact lever is pivotally attached to said second pin, and is connected to said output terminal through said braided conducting segment.

7. A circuit breaker according to claim 6, wherein said output terminal comprises a third strip-shaped conductor supporting said bimetallic element, to which braided conducting segment is connected.

8. A circuit breaker according to claim 1, wherein at least said pawl and said release lever of said toggle joint means are made of an insulating material.

9. A circuit breaker according to claim 1, wherein the walls of said housing which separate said compartments from each other have the same height as the side walls of said housing.

10. A circuit breaker with a manual release comprising:

a manual lever;

a movable contact lever means for opening and closing the electrical circuit through the circuit breaker by moving between an opened and a closed position;

a magnetic triggering means, for sensing severe excess current running through the circuit breaker;

a toggle joint means, for moving said contact lever means from the closed position to the open position and from the open position to the closed position in response to movement of said manual lever and in response to said magnetic triggering means; said toggle joint means being disposed in a substantially straight line between said manual lever and said movable contact lever means, said movable contact lever means being swivelably attached to said toggle joint means;

a hinged armature, connected to said magnetic triggering means;

a triggering lever, attached to said toggle joint means, for triggering said toggle joint means to cause said movable contact lever to open or close the circuit in the circuit breaker in response to said hinged armature contacting said triggering lever; and a housing in which the circuit breaker is disposed, having separate compartments for said magnetic triggering means, said movable contact lever means, and said toggle joint means, said magnetic triggering means and said movable contact lever means being disposed laterally from said toggle joint means, said compartment for said movable contact lever means being below said compartment for said magnetic triggering means and forming part of the bottom of said housing, said movable contact lever means being disposed in said compartment substantially parallel to the bottom of said housing; and wherein said toggle joint means is separated from said magnetic triggering means and compartment and said movable contact lever means compartment by a lengthwise insulating wall, said wall having an opening for said hinged armature and said release lever as well as a slot through which said movable contact lever passes.

11. A circuit breaker with a manual release comprising:

a manual lever;

a movable contact lever means for opening and closing the electrical circuit through the circuit breaker by moving between an opened and a closed position;

a magnetic triggering means, for sensing severe excess current running through the circuit breaker;

a toggle joint means, for moving said contact lever means from the closed position to the open position and from the open position to the closed position in response to movement of said manual lever and in response to said magnetic triggering means; said toggle joint means being disposed in a substantially straight line between said manual lever and said movable contact lever means, said movable contact lever means being swivelably attached to said toggle joint means;

a hinged armature, connected to said magnetic triggering means;

a triggering lever, attached to said toggle joint means, for triggering said toggle joint means to cause said movable contact lever to open or close the circuit in the circuit breaker in response to said hinged armature contacting said triggering lever;

a housing in which the circuit breaker is disposed, having separate compartments for said magnetic triggering means, said movable contact lever means, and said toggle joint means, said magnetic triggering means and said movable contact lever means being disposed laterally from said toggle joint means, said compartment for said movable contact lever means being below said compartment for said magnetic triggering means and forming part of the bottom of said housing, said movable contact lever means being disposed in said compartment substantially parallel to the bottom of said housing;

an input terminal;

an output terminal; and first and second strip-shaped conductors attached, respectively to the upper and lower walls of said movable contact lever means compartment, said first strip-shaped conductor being connected to said input terminal, and said second strip-shaped conductor being attached to said output terminal, a side wall of said movable contact lever means compartment on the side opposite from said toggle joint means compartment, having a gas opening therein for allowing gases created in said movable contact lever means compartment to escape.

12. A circuit breaker, according to claim 11, further including a gas-deflecting rib disposed in said movable contact lever means compartment in front of the gas opening in a side wall of said movable contact lever means compartment.

13. A circuit breaker, according to claim 11, wherein said magnetic triggering means includes a magnetic winding, one end of which is connected to said first strip-shaped conductor, the other end of which is connected to said input terminal; and wherein said circuit breaker further includes:

a fixed contact, attached to and supported by said first strip-shaped conductor, wherein said movable contact lever contacts said fixed contact when said movable contact lever is in the closed position.

* * * * *